US006220375B1

(12) United States Patent
Butcher et al.

(10) Patent No.: US 6,220,375 B1
(45) Date of Patent: Apr. 24, 2001

(54) POLYCRYSTALLINE DIAMOND CUTTERS HAVING MODIFIED RESIDUAL STRESSES

(75) Inventors: Trent N. Butcher, Sandy; Ralph M. Horton, Murray, both of UT (US); Stephen R. Jurewicz, Northridge, CA (US); Danny E. Scott, Montgomery, TX (US); Redd H. Smith, Salt Lake City, UT (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/231,350

(22) Filed: Jan. 13, 1999

(51) Int. Cl.[7] ..... E21B 10/36
(52) U.S. Cl. ..... 175/428; 175/434; 175/432
(58) Field of Search ..... 175/331, 420.1, 175/420.2, 425, 426, 428, 432–434; 419/11, 18, 25, 29, 39, 47, 48, 53, 54

(56) References Cited

U.S. PATENT DOCUMENTS

| | | | |
|---|---|---|---|
| 4,398,952 | 8/1983 | Drake . | |
| 4,484,644 | 11/1984 | Cook et al. . | |
| 4,604,106 | 8/1986 | Hall et al. . | |
| 4,956,238 | 9/1990 | Griffin . | |
| 5,022,894 | 6/1991 | Vagarali et al. . | |
| 5,032,147 | 7/1991 | Frushour . | |
| 5,049,164 | 9/1991 | Horton et al. . | |
| 5,135,061 | 8/1992 | Newton, Jr. . | |
| 5,176,720 | 1/1993 | Martell et al. . | |
| 5,304,342 | 4/1994 | Hall, Jr. et al. . | |
| 5,332,051 | 7/1994 | Knowlton . | |
| 5,355,969 | 10/1994 | Hardy et al. . | |
| 5,510,193 * | 4/1996 | Cerutti et al. | 428/552 |
| 5,598,750 | 2/1997 | Griffin et al. . | |
| 5,669,271 | 9/1997 | Griffin et al. . | |
| 5,688,557 | 11/1997 | Lemelson et al. . | |
| 5,701,578 | 12/1997 | Liu . | |
| 5,738,698 * | 4/1998 | Kapoor et al. | 51/309 |
| 5,816,347 | 10/1998 | Dennis et al. . | |
| 5,875,862 | 3/1999 | Jurewicz et al. . | |

FOREIGN PATENT DOCUMENTS

| | | |
|---|---|---|
| 2258260 | 2/1993 | (GB) . |
| 2307931 | 6/1997 | (GB) . |

OTHER PUBLICATIONS

Search Report dated May 11, 2000.
Vishay, Measurements Group, Inc., Tech Note (TN–515), "Strain Gage Rosettes—Selection, Application and Data Reduction," (1990), pp. 1–10.
Lin, Tze–Pin, et al., "Residual Stresses in Polycrystalline Diamond Compacts," *J. Am. Ceram. Soc.,* vol. 77, No. 6, (1994), pp. 1562–1568.
Miess, D., et al., "Fracture Toughness and Thermal Resistance of Polycrystalline Diamond Compacts," *Materials Science and Engineering,* A209, (1996), pp. 270–276.
Krawitz, A.D., et al., "Residual Stresses in Polycrystalline Diamond Compacts," *Internat'l. Jour. of Refractory Metals & Hard Materials,* vol. 17, (1999), pp. 117–122.
Schwartz, I.F., "Residual Stress Determination in Hardmetal and Polycrystalline Diamond Using the Air–Abrasive Blind–Hole Drilling Technique," *PMI,* vol. 22, No. 5, (1990), pp. 18–22.

* cited by examiner

*Primary Examiner*—Roger Schoeppel
(74) *Attorney, Agent, or Firm*—Trask Britt

(57) ABSTRACT

The residual stresses that are experienced in polycrystalline diamond cutters, which lead to cutter failure, can be effectively modified by selectively thinning the carbide substrate subsequent to high temperature, high pressure (sinter) processing, by selectively varying the material constituents of the cutter substrate, by subjecting the PDC cutter to an annealing process during sintering, by subjecting the formed PDC cutter to a post-process stress relief anneal, or a combination of those means.

26 Claims, 11 Drawing Sheets

POLYCRYSTALLINE DIAMOND CUTTERS HAVING MODIFIED RESIDUAL STRESSES

BACKGROUND OF THE INVENTION

1. Field of the Invention

This invention relates to polycrystalline diamond cutters for use in earth boring bits. Specifically, this invention relates to polycrystalline diamond cutters which have modified substrates to selectively modify and alter residual stress in the cutter structure.

2. Statement of the Art

Polycrystalline diamond compact cutters (hereinafter referred to as "PDC" cutters) are well-known and widely used in drill bit technology as the cutting element of certain drill bits used in core drilling, oil and gas drilling, and the like. Polycrystalline diamond compacts generally comprise a polycrystalline diamond (hereinafter "PCD") table formed on a carbide substrate by a high temperature-high pressure (HTHP) sintering process. The PCD table and substrate compact may be attached to an additional or larger (i.e., longer) carbide support by, for example, a brazing process. Alternatively, the PCD table may be formed on an elongated carbide substrate in a sintering process to form the PDC with an integral elongated support. The support of the PDC cutter is then brazed or otherwise attached to a drill bit in a manner which exposes the PCD table to the surface for cutting.

It is known that PDC cutters, by virtue of the materials comprising the PCD table and the support, inherently have residual stresses existing in the compact therebetween, throughout the table and the carbide substrate, and particularly at the interface. That is, the diamond and the carbide have varying coefficients of thermal expansion, elastic module and bulk compressibilities such that when the PDC cutter is formed, the diamond and the carbide shrink by different amounts. As a result, the diamond table tends to be in compression while the carbide substrate and/or support tend to be in tension. Fracturing of the PDC cutter can result, often in the interface between the diamond table and the carbide, and/or the cutter may delaminate under the extreme temperatures and forces of drilling.

Various solutions have been suggested in the art for modifying the residual stresses in PDC cutters so that cutter failure is avoided. For example, it has been suggested that configuring the diamond table and/or carbide substrate in a particular way may redistribute the stress such that tension is reduced, as disclosed in U.S. Pat. No. 5,351,772 to Smith and U.S. Pat. No. 4,255,165 to Dennis. Other cutter configurations which address reduced stresses are disclosed in U.S. Pat. No. 5,049,164 to Horton; U.S. Pat. No. 5,176,720 to Martell, et al.; U.S. Pat. No. 5,304,342 to Hall; and U.S. Pat. No. 4,398,952 to Drake (in connection with the formation of roller cutters).

Recent experimental testing has shown that the residual stress state of the diamond table of a PDC cutter can be controlled by novel means not previously disclosed in the literature. That is, results have shown that a wide range of stress states, from high compression through moderate tension, can be imposed on the diamond table by selectively tailoring the carbide substrate. Thus, it would be advantageous in the art to provide a PDC cutter having selectively tailored stress states, and to provide methods for producing such PDC cutters.

BRIEF SUMMARY OF THE INVENTION

In accordance with the present invention, a polycrystalline diamond compact cutter having a tailored carbide substrate which favorably alters the compressive stresses in the diamond table and residual tensile stresses within the carbide substrate is provided to produce a PDC cutter with improved stress characteristics. Modification of the substrate to tailor the stress characteristics in the diamond table and substrate may be accomplished by selectively thinning the carbide substrate subsequent to HTHP processing, by selectively varying the material constituents of the substrate, by subjecting the PDC to an annealing process during sintering, by subjecting the formed PDC to a post-process stress relief anneal, or a combination of those means.

The PDC cutters of the present invention are comprised of a polycrystalline diamond table, a carbide substrate on which the polycrystalline diamond table is formed (e.g., sintered) and, optionally, a carbide support of typically greater thickness than either the diamond table or the substrate to which the substrate is connected (e.g., brazed). However, it has been discovered that a wide range of stress states, from high compression through moderate tension, can be imposed in the diamond table by selectively tailoring the carbide substrate thickness. The carbide substrate may be formed with a selected thickness by the provision of sufficient carbide material during the HTHP sintering process to produce the desired thickness. In addition, or alternatively, once the PDC cutter is formed, the substrate may be selectively thinned by subjecting it to a grinding process or machining or by electro-discharge machining processes.

It has been shown through experimental and numerical residual stress analyses that the magnitude of stress existing in the diamond table is related to the thickness of the support. Thus, within a suitable range, the carbide substrate of the cutter may be thinned to achieve a desired magnitude of stress in the diamond table appropriate to a particular use. The achievement of an appropriate or desired degree of thinness in the carbide support, and therefore the desired magnitude of stress, may be determined by residual stress analyses.

The substrate of the PDC cutter may typically be made of cobalt-cemented tungsten carbide (WC), or other suitable cemented carbide material, such as tantalum carbide, titanium carbide, or the like. The cementing material, or binder, used in the cemented carbide substrate may be cobalt, nickel, iron, or alloys formed from combinations of those metals, or alloys of those metals in combination with other materials or elements. Experimental testing has shown that introduction of a selective gradation of materials in the substrate will produce suitable stress states in the carbide substrate and diamond table. For example, the use of varying qualities of grades or percentages of cobalt-cemented (hereinafter "Co-cemented") carbides in the substrate produces very suitable states of compression in the diamond table and reduced residual tensile stress in the carbide substrate and provides increased strength in the cutter.

It has also been shown that a PDC cutter with suitably modified stress states in the diamond table and substrate may be formed by selectively manipulating the qualities of grades or percentages of binder content, carbide grain size or mixtures of binder or carbide alloys in the substrate. Thus, the specific properties of the cutter may be achieved through selectively dictating the metallurgical content of the substrate. Further, subjecting the PDC cutter of the present invention to an annealing step during the sintering process increases the hardness of the diamond table. Subjecting the formed (sintered) PDC cutter to a post-process stress relief anneal procedure provides a further means for selectively tailoring the stresses in the PDC cutter and improves significantly the hardness of the diamond table. Additionally, tailoring the thickness of the backing and/or subjecting the substrate to the disclosed annealing processes also provides selected suitable stress states in the diamond table and support.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

It is known that the difference in coefficients of thermal expansion between diamond and carbide materials results in the bulk of the diamond table of a PDC cutter being in compression and the bulk of the carbide substrate being in tension following the HTHP sintering process used to form a PDC cutter. The respective existences of compression and tension states in the diamond table and substrate components of a PDC cutter have been demonstrated through residual stress analyses. Residual stress analyses have also demonstrated, however, an ability to tailor the residual stress states which exist in the diamond table and substrate of the PDC cutter by reducing the thickness of the carbide substrate, or varying the properties of the carbide substrate.

Figure 1:
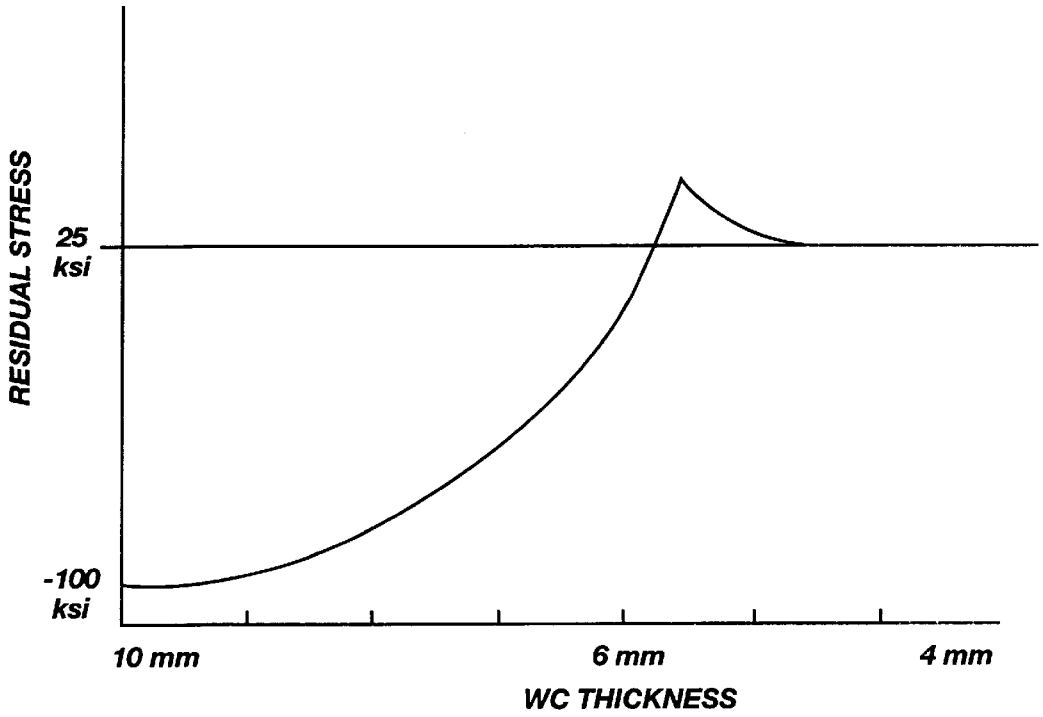
FIG. 1 is a graph representing the post-HTHP relationship between thickness of the carbide substrate and stress states existing in the surface of the diamond table.

The correlation is illustrated by FIG. 1 where residual stress states at the interface between the diamond table and the substrate are represented on the y-axis and relative thicknesses of the carbide substrate are represented on the x-axis. Testing with a tungsten carbide substrate sintered to a diamond table indicates that at a carbide substrate thickness about 0.39 inches (about 10 mm), the residual stress in the diamond table tends to be in the range of about −100 ksi to −80 ksi (about −689 MPa to about −551 MPa). As the thickness of the substrate is decreased to about 0.24 inches (about 6 mm), the residual stress in the diamond table approaches zero ksi, and further reduction of the thickness of the substrate results in residual tensile stresses before further reductions in thickness reduce the diamond to a zero stress state. Thus, it can be seen that a selected stress state in the cutter may be achieved by selectively thinning the substrate to the thickness required to achieve that desired residual stress state. Generally, it is thought to be desirable to reduce the residual tensile stresses in the carbide substrate to a minimum level. However, it may be desirable to produce a cutter with an otherwise elevated residual tensile stress state in the substrate in order to meet the particular needs of an application or operation. For example, substrate thicknesses ranging from about 0.67 inches to about 0.16 inches (about 17 mm to about 4 mm) for a cutter having a three-quarter inch diameter may be particularly suitable in terms of the stresses achieved in the substrate. The suitable thickness of the substrate will depend on the diameter of the cutter and the intended drilling environment.

Figure 2:
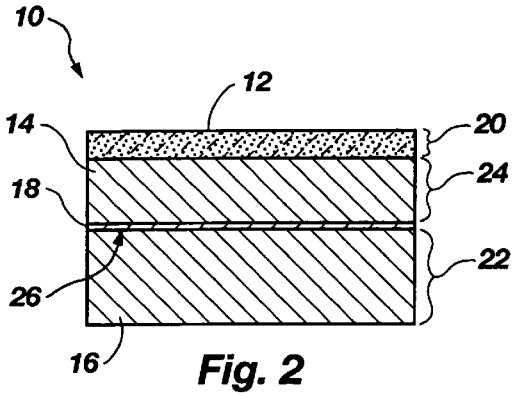
FIG. 2 is a view in cross section of a PDC cutter of the present invention having a selectively thinned carbide substrate containing 13% cobalt.

Accordingly, in a first embodiment of the invention, represented in FIG. 2, a PDC cutter 10 is formed with a polycrystalline diamond table 12 and a carbide substrate 14 connected to the polycrystalline diamond table 12. The polycrystalline diamond table 12 may be formed on the carbide substrate 14 in a conventional manner, such as by an HTHP sintering process. The carbide substrate 14 may then be connected to an additional carbide support 16, also called a cylinder, by such methods as a braze joint 18. The polycrystalline diamond table 12 may be of conventional thickness 20, approximately 1.0 mm to about 4 mm (about 0.04 inches to about 0.157 inches). The carbide support 16 may generally be formed of any suitable carbide material, such as tungsten carbide, tantalum carbide or titanium carbide with various binding metals including cobalt, nickel, iron, metal alloys, or mixtures thereof. The thickness 22 of the carbide support 16 may range, depending on the cutter diameter, from about 5 mm to about 16 mm (about 0.2 inches to about 0.6 inches).

The carbide substrate 14 of the illustrated embodiment may be comprised of any conventional cemented carbide, such as tungsten carbide, tantalum carbide or titanium carbide. Additionally, the substrate may contain additional material, such as cobalt, nickel, iron or other suitable material. The carbide substrate 14 may be selectively thinned, subsequent to sintering, from its original thickness to achieve a desired residual stress state by any of a number of methods. For example, the thickness 24 of the carbide substrate 14 may be selected initially, in the formation of the PDC cutter 10, to provide a final, post-sintering carbide substrate 14 of the desired thickness 24. Alternatively, the carbide substrate 14 may be formed by conventional methods to a conventional thickness, and the carbide substrate 14 may thereafter be selectively thinned along the planar surface 26 to which the carbide support 16 is thereafter joined. The carbide substrate 14 may be thinned by grinding the planar surface 26 using grinding methods known in the art, or the carbide substrate 14 may be thinned by employing an electro-discharge or other machining process. The carbide substrate 14 is thinned to remove a sufficient amount of material from the carbide substrate 14 to achieve the desired residual stress levels. The carbide substrate 14 and polycrystalline diamond table 12 assembly may then be attached to the additional carbide support 16 by brazing or another suitable technique.

Alternatively, the polycrystalline diamond table 12 may be formed on the carbide substrate 14 by conventional methods to provide a conventional thickness, and the polycrystalline diamond table 12 and carbide substrate 14 assembly may then be joined to the additional carbide support 16. Thereafter, the total thickness of the carbide substrate 14 plus carbide support 16 may be modified by grinding, machining (e.g., sawing) or by electro-discharge machining processes.

Figure 3:
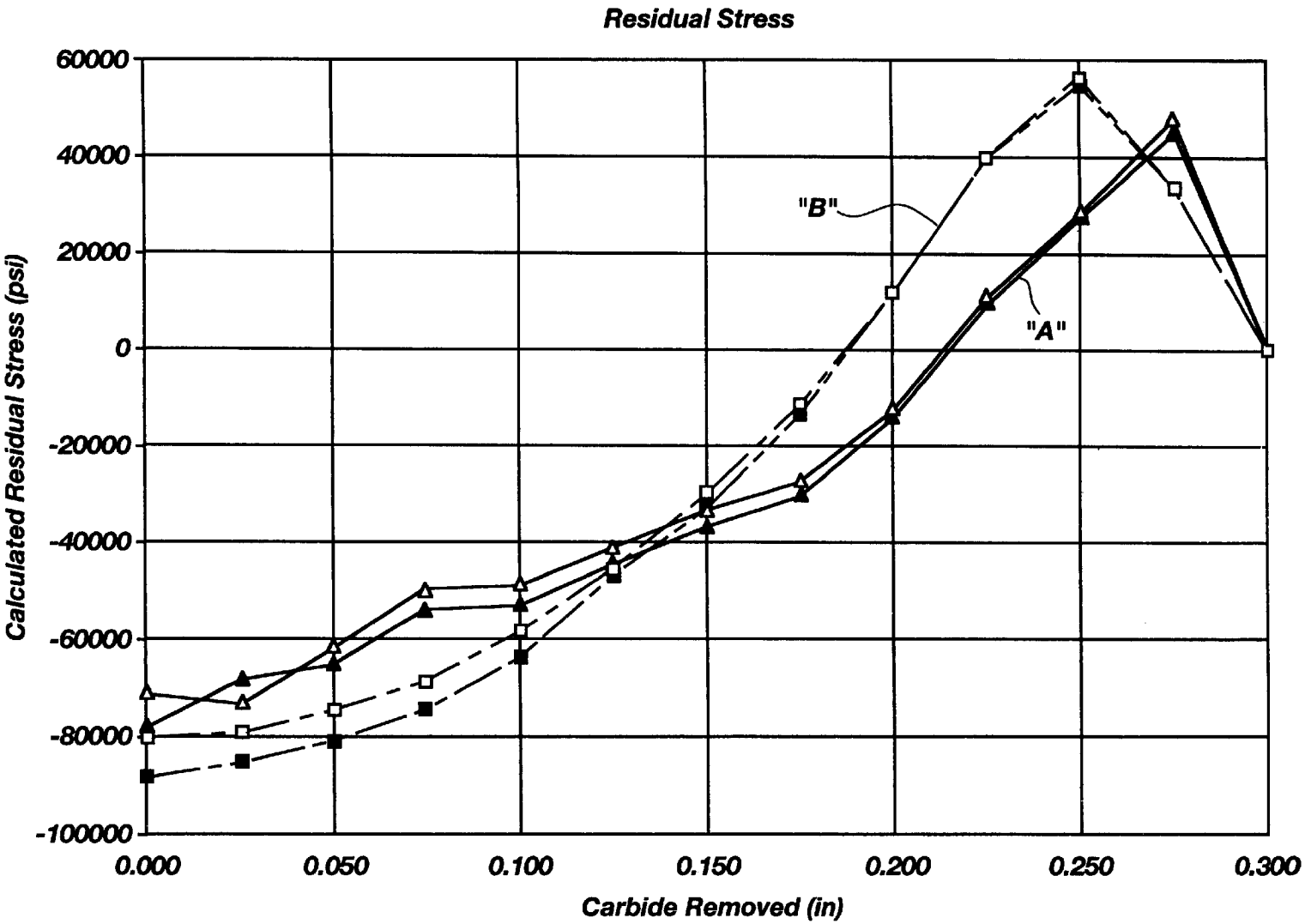
FIG. 3 is a graph illustrating residual stress analyses of a cutter comprised of a 13% cobalt-containing substrate integrally formed with the carbide support in comparison with the residual stress analyses of a cutter, as shown in FIG. 2, which is attached to a 5 mm support.
Figure 4:
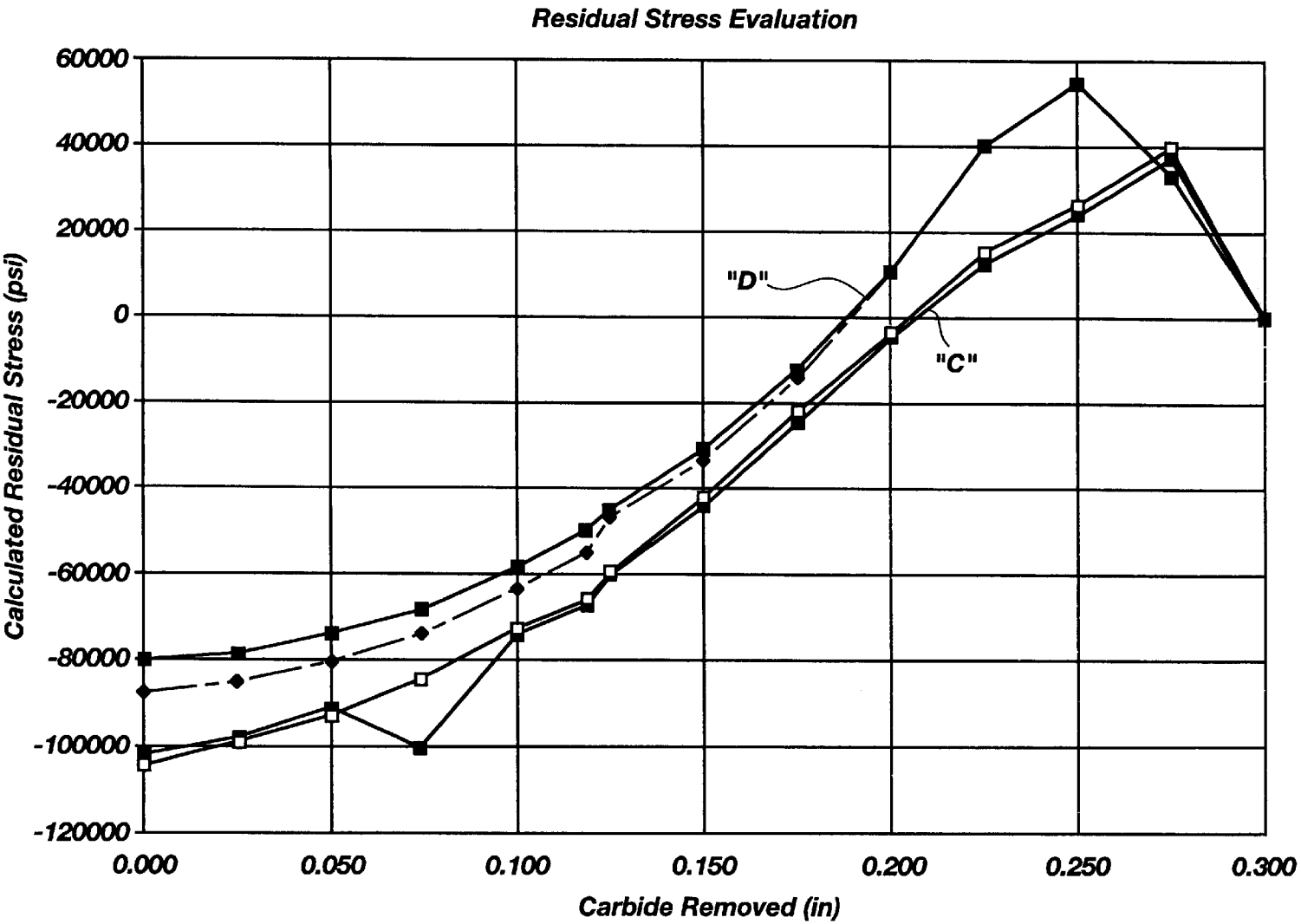
FIG. 4 is a graph illustrating residual stress analyses of a cutter comprised of a 13% cobalt-containing substrate integrally formed with the carbide support in comparison with the residual stress analyses of a cutter of the type shown in FIG. 2, which is attached to a 3 mm support.

FIGS. 3 and 4 illustrate that an advantageous effect on modifying residual stress is gained by thinning the carbide substrate 14 prior to attaching the carbide substrate 14 to the carbide support 16, as compared to the residual stresses experienced in a substrate that is integrally formed with the carbide support 16. FIG. 3, for example, compares a cutter "A" comprised of a 13% cobalt-containing substrate of selected thickness (e.g., 3 mm 10–12 inches), which was thinned to that selected thickness prior to attachment, such as by brazing, to a 5 mm (0.2 inches) carbide support, with a cutter "B" comprised of a 13% cobalt-containing substrate integrally formed with a carbide support and subsequently thinned to a selected thickness comparable to cutter "A" (e.g., 8 mm/0.3 inches). FIG. 3 illustrates that as the cutter B is reduced in thickness by the removal of carbide from the support, a beneficial change in residual stress is experienced until a maximum effect is achieved at about a 0.25 inch removal of carbide. Cutter "A" also shows an improved residual stress state at that point in comparison to cutter "B".

FIG. 4 similarly illustrates a cutter "C" comprised of a 13% cobalt-containing substrate of selected thickness (e.g., 5 mm/0.20 inches), which was thinned to that selected thickness prior to attachment to a 3 mm (0.12 inches) carbide support, compared with a cutter "D" comprised of a 13% cobalt-containing substrate integrally formed with a carbide support and thinned to a selected thickness comparable to cutter "C" (e.g., 8 mm 10.31 inches). FIG. 4 illustrates that as the cutter is reduced in thickness by the removal of carbide from the substrate, a beneficial change in residual stress is experienced with cutter "C" demonstrating an increased benefit in modification of the residual stress state.

Figure 7:
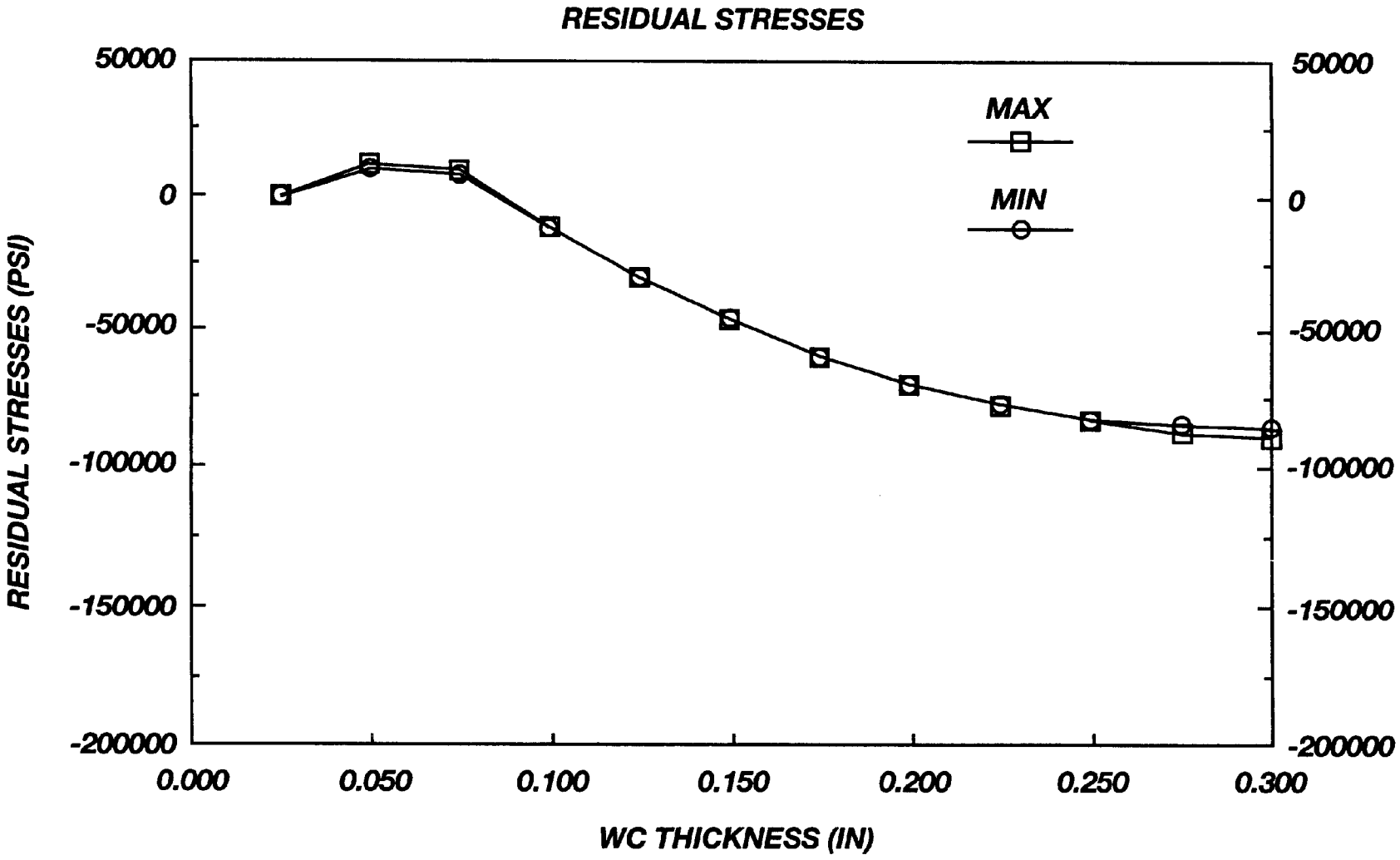
FIG. 7 is a graph illustrating residual stress analyses conducted on a PDC cutter having a substrate with a 13% cobalt content integrally formed to a carbide support where the cutter was made in a belt press.

FIG. 7 also demonstrates the advantageous effect on residual stress in the substrate of a PDC cutter resulting from a reduction of the substrate thickness. As illustrated in FIG.7, residual stress analyses were performed on a conventional PDC cutter comprising a diamond table having a thickness of between about 0.028 inches and 0.030 inches (about 0.71 mm and about 0.76 mm) and a carbide substrate composed of 13% cobalt, which was thinned from about 0.300 inches to about 0.025 inches (about 7.62 mm to about 0.64 mm). The graph of FIG. 7 illustrates that as the thickness of the carbide support is decreased, the residual tensile stress in the substrate of the cutter is advantageously modified.

The residual stresses in the diamond table of a PDC cutter may also be modified and tailored by selectively modifying the materials content of the substrate of the PDC cutter. Specifically, a PDC cutter 30, as illustrated FIG. 5, may be formed with a diamond table 32 connected to a substrate 34 having a varying or graded materials content. The substrate 34 may, in turn, be attached to a carbide support 36. The formation of the substrate 34 of this embodiment may be accomplished by joining together two or more disparate carbide discs 38, 40 in the HTHP sintering process to form the PDC cutter. The carbide discs 38, 40 may vary from each other in binder content, carbide grain size, or carbide alloy content. The carbide discs 38, 40 may be selected and arranged, therefore, to produce a gradient of materials content in the substrate which modifies and provides the desired compressive or reduced residual tensile stress states in the diamond table 32.

Figure 14A:
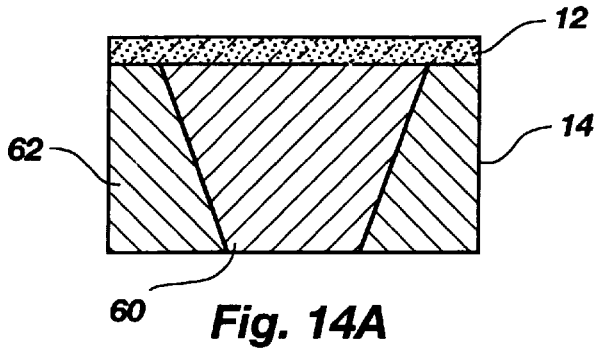
FIGS. 14A–C are views in cross section of alternative configurations for forming a substrate with varying materials content.
Figure 14B:
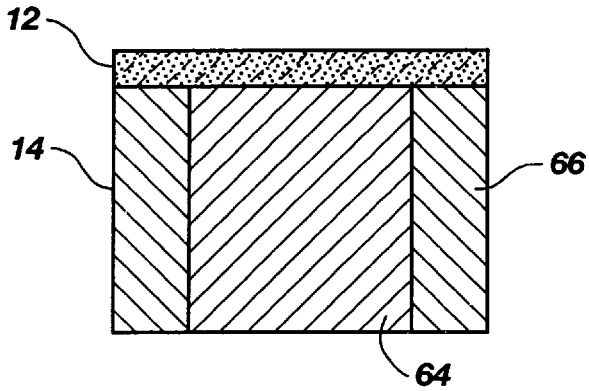
Figure 14C:
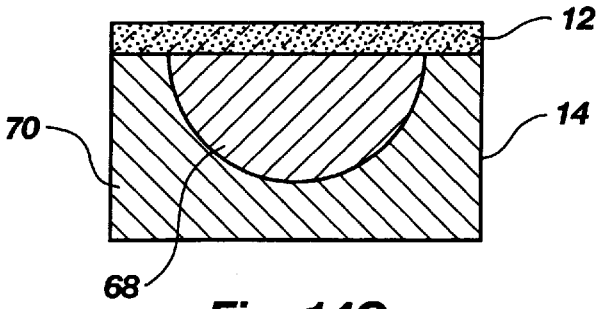

Alternatively, as shown in FIGS. 14A, 14B and 14C, a substrate 14 of varying materials content can be produced by conjoining in a sintering or other suitable process substructures of the substrate 14, each of which contains a different material composition or make-up. For example, FIG. 14A illustrates a substrate of varying materials content comprised of a conically-shaped inner element 60 surrounded by an outer tubular body 62 sized to receive the conically-shaped inner element 60 prior to sintering. The conically-shaped inner element 60 may, for example, contain 13% cobalt while the outer tubular body 62 contains 20% cobalt. By further example, FIG. 14B illustrates a substrate 14 formed of an inner cylinder 64 of, for example 16% cobalt surrounded by an outer tubular body 66 of 20% cobalt-containing carbide. FIG. 14C further illustrates another alternatively formed substrate 14 comprised of an inversely dome-shaped member 68 having, for example, a cobalt content of 13% which is received within an outer member 70 of 20% cobalt-containing carbide formed with a cup-shaped depression sized to receive the dome-shaped member 68 therein prior to sintering. Any number of other shapes of elements may be combined to produce a substrate of varying materials content in accordance with the present invention.

By way of example only, and again with reference to FIG. 5, a PDC cutter 30 may be formed by joining together, in the HTHP sintering process, a first carbide disc 38 having a 13% cobalt content and a second carbide disc 40 having a 16% cobalt content. The two carbide discs 38, 40 are placed in a cylinder for processing along with diamond grains in the conventional manner for forming a PDC cutter. The diamond and carbide discs are then subjected to a sintering cycle with an in-process annealing procedure which comprises the steps of 1) ramping up to a pressure of 60 K bars and temperature of 1450° C. over a period of one minute; 2) processing the sintering cycle for eight minutes; 3) ramping down the temperature approximately 100° C. while maintaining a constant pressure to get below the solidus of the carbide material; 4) maintaining a dwell of four to six minutes to anneal the sintered mass, and 5) finally ramping down the cycle over approximately a two-minute period. A compact, formed by the described process, produces a PDC cutter having favorably altered residual stress patterns. The residual stress in the PDC cutter, thus formed, is modified from that of a cutter with a single 13% or 16% cobalt-cemented carbide material. As illustrated in FIG. 6, the cutter 50 may be comprised of a substrate 14 having three or more layers of similar or disparate materials. FIG. 6 illustrates a cutter 50 having a first layer 52 containing 13% cobalt, a second layer 54 containing 16% cobalt and a third layer 56 containing 20% cobalt. The thickness of the layers may be varied or may be the same.

Figure 8:
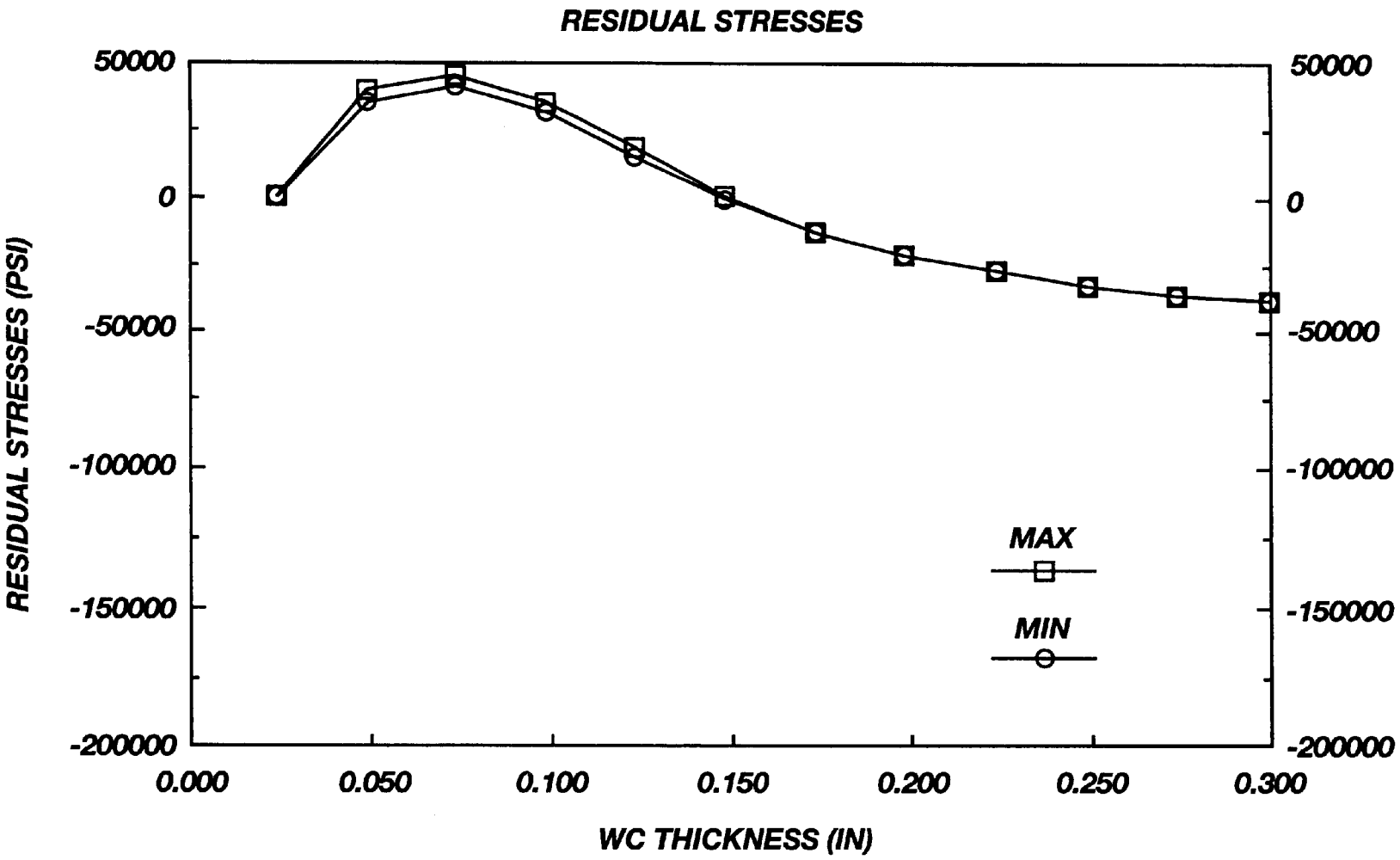
FIG. 8 is a graph illustrating residual stress analyses conducted on a PDC cutter having a substrate with a 16% cobalt content where the cutter was made in a belt press.
Figure 9:
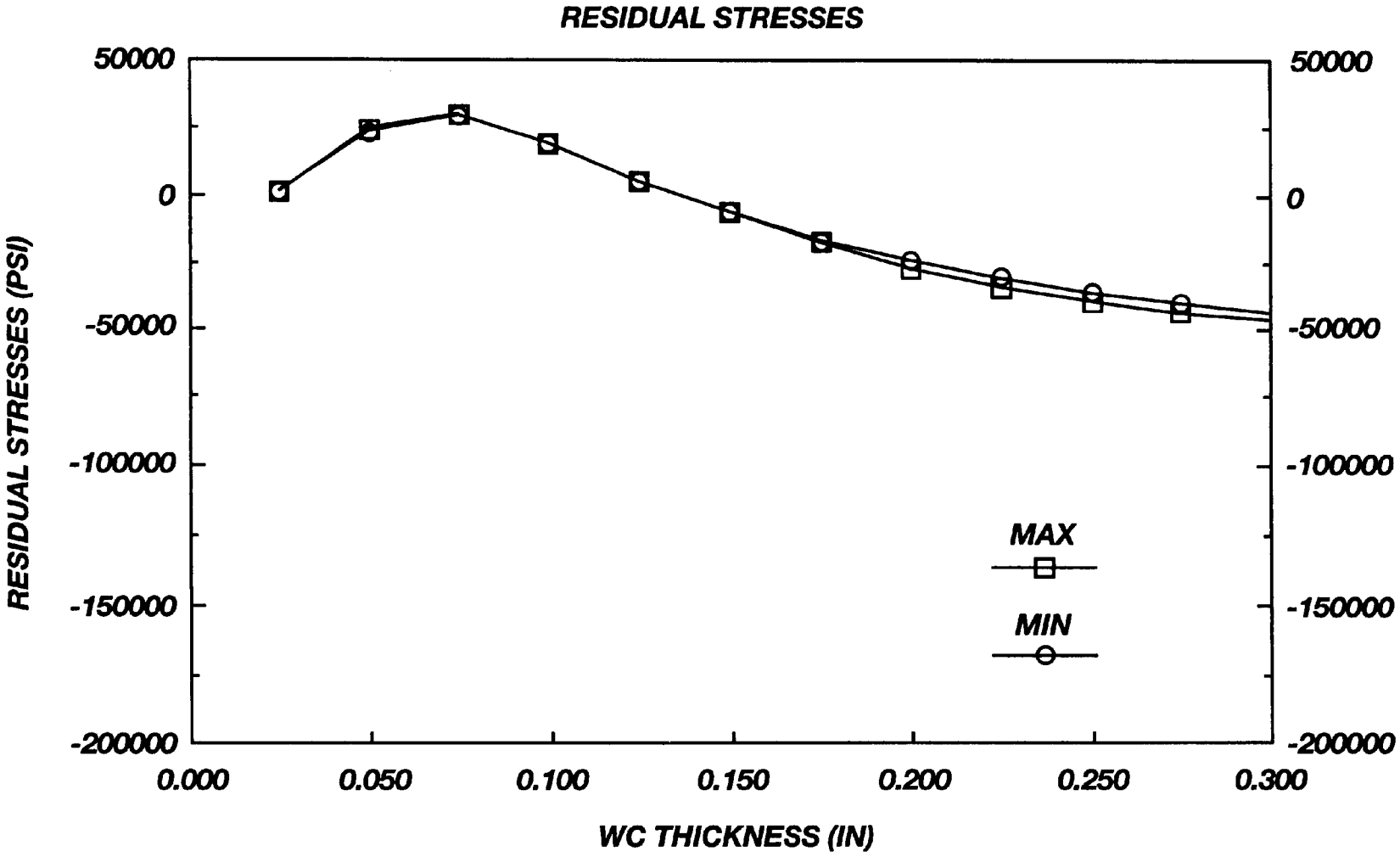
FIG. 9 is a graph illustrating residual stress analyses conducted on a PDC cutter as shown in FIG. 5 made in a belt press.

The advantageous modification of residual stress in the substrate resulting from a selected modification of the material of the substrate is demonstrated in FIGS. 7, 8 and 9, which illustrate residual stress analyses performed on various cutter embodiments, each of which was formed using a conventional belt press method. FIG. 7, as previously described, illustrates residual stress analyses performed on a conventional PDC cutter comprising a diamond table having a thickness of between about 0.028 inches and 0.030 inches (0.71 mm to about 0.76 mm) and a carbide substrate composed of 13% cobalt. FIG. 8 illustrates residual stress tests that were performed on a PDC cutter as shown in FIG. 2 having a single layer substrate composed of 16% cobalt where the thickness of the polycrystalline diamond table 12 was from about 0.028 inches to about 0.030 inches (0.71 mm to about 0.76 mm) and the carbide substrate varied in thickness from about 0.300 inches to about 0.025 inches (about 7.62 mm to about 0.64 mm). FIG. 9 illustrates residual stress analyses performed on a PDC cutter as shown in FIG. 5 where the thickness of the diamond table 32 was between 0.028 inches and 0.030 inches (about 0.71 mm to about 0.76 mm) the combined thickness of the first carbide disc 38 (13% cobalt) and the second carbide disc 40 (16% cobalt) ranged from between about 0.028 inches and 0.030 inches.

FIG. 7 illustrates that a maximum compressive stress of about 75,000 psi (about 517 MPa) is achieved at a carbide substrate thickness of about 0.300 inches, but reducing the carbide thickness achieves a residual tensile stress of about 10,000 psi (about 69 MPa) for a full spread of 85,000 psi (about 586 MPa). FIG. 8 illustrates that a maximum compressive stress reaches about −40,000 psi and, upon reduction of the carbide thickness, residual tensile stress is modified to +45,000 psi (about 310 MPa) with an overall change of 85,000 psi (about 586 MPa). FIG. 9 illustrates that the maximum residual compressive stress in a bi-layered cutter (FIG. 5) is about 45,000 psi(about 310 MPa), but a residual tensile stress of about 25,000 psi (about 172 MPa) is achieved through reduction of the carbide thickness, resulting in an overall change of 70,000 psi (about 483 ) or 18%.

Figure 10:
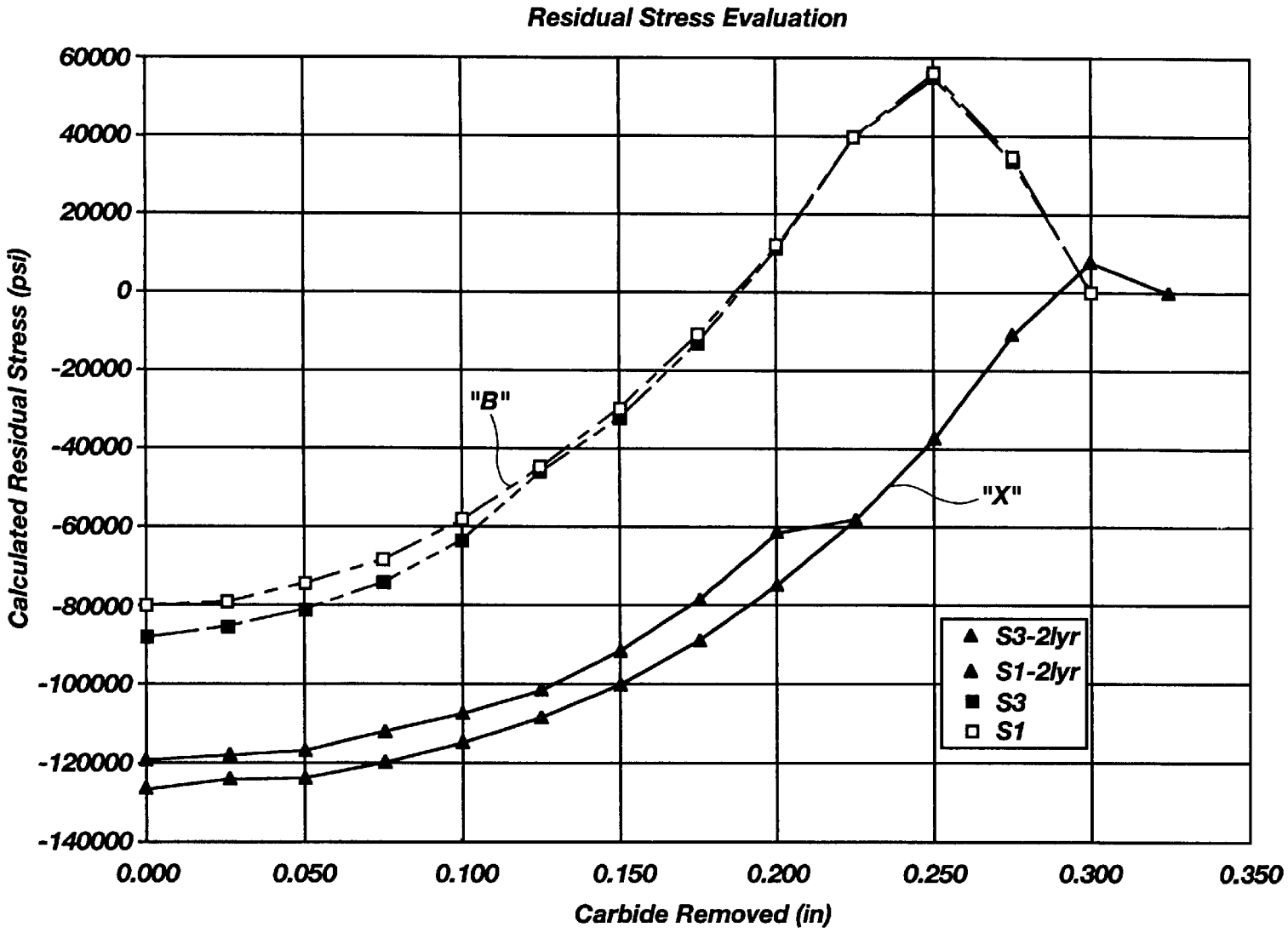
FIG. 10 is a graph illustrating the residual stress analyses of a cutter comprised of a substrate containing 13% cobalt integrally formed to a carbide support compared to the residual analyses of the cutter shown in FIG. 5 made in a cubic press.
Figure 11:
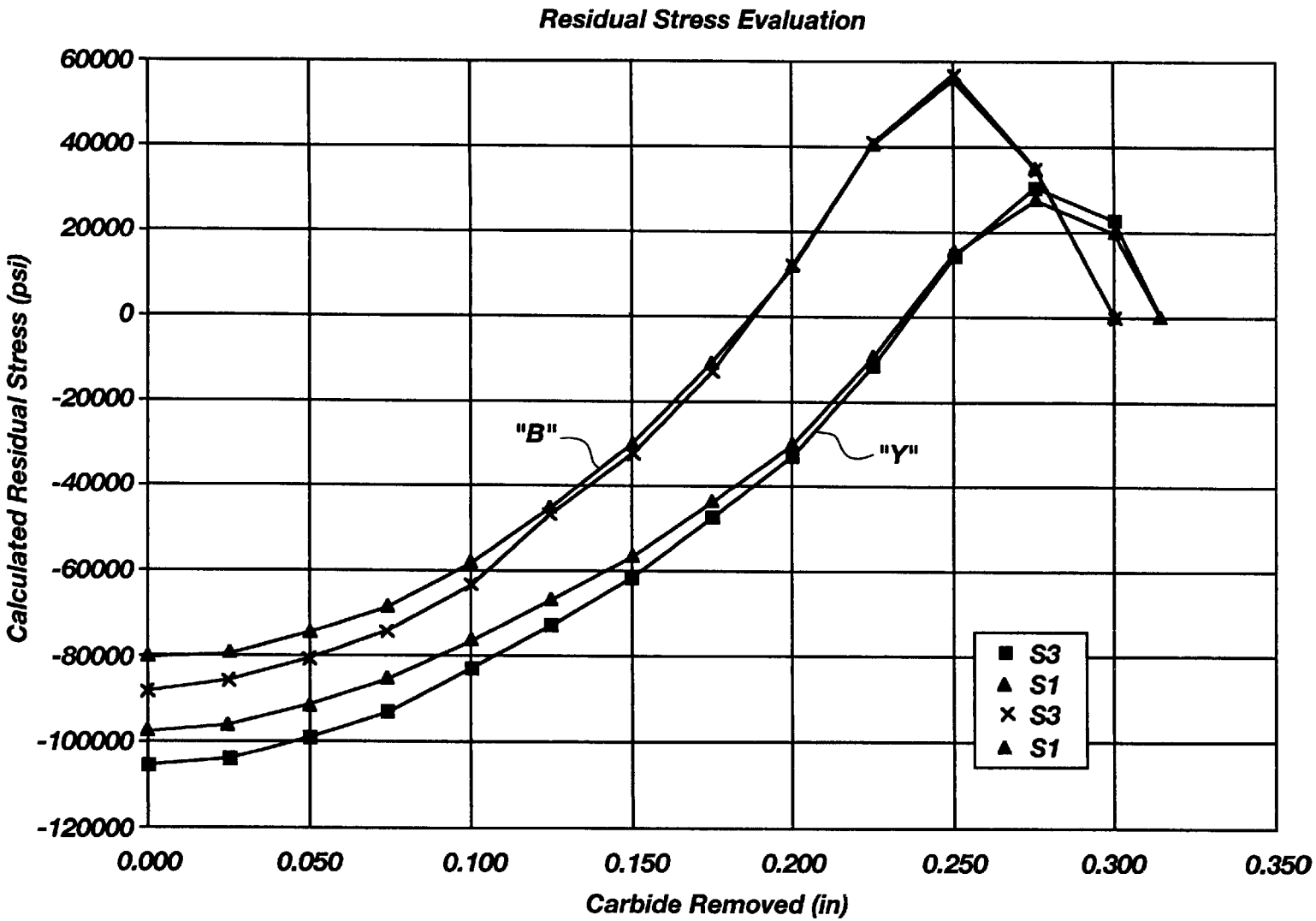
FIG. 11 is a graph illustrating the residual stress analyses of a cutter comprised of a substrate containing 13% cobalt integrally formed to a carbide support compared to the residual analyses of the cutter shown in FIG. 6 made in a cubic press.

FIGS. 3, 10 and 11 further demonstrate the advantageous change in residual stress in the substrate on cutters produced using a cubic press. Thus, FIG. 3 illustrates residual stress analyses on a cutter as shown in FIG. 2, denoted "A", in comparison with a standard cutter where the substrate, containing 13% cobalt, is integrally formed with the support, denoted "B." FIG.10 illustrates residual stress analyses on a cutter, denoted "X" as shown in FIG. 5, in comparison with the standard, integrally formed cutter, denoted "B." FIG. 11 illustrates residual stress analyses on a cutter as shown in FIG. 6, denoted "Y", in comparison with the standard integrally formed cutter "B". In FIG. 3, it is shown that the maximum residual compressive stress in cutter "B" is 85,000 psi (about 586 MPa), and reducing the carbide thickness achieves a peak tensile stress of 58,000 psi (about 400 MPa), with an overall change of 143,000 psi (about 986 MPa). FIG. 10 demonstrates that the maximum residual compressive stress in cutter "X" is about 128,000 psi (about 882 MPa), but with reduction of the carbide the maximum residual tensile stress reaches about 8,000 psi (about 882 MPa), with an overall change of 136,000 psi (about 983 MPa). The direction of the modification of the residual stress is substantially different than that experienced in cutter "B." FIG. 11 illustrates that the maximum residual compressive stress for cutter "Y" is 112,000 psi (about 772 MPa) and reduction of the carbide support thickness achieves a maximum residual tensile stress of 30,000 psi (about 207 MPa) with an overall change of 142,000 psi (about 965 MPa). Formation of the cutter in a belt press results in a greater change in residual stresses for given substrate thicknesses as compared to cutters made in a cubic press. Further, while the maximum residual compressive stress is much higher for cutters made in a cubic press, the maximum residual tensile stresses are much lower in layered or graded substrates as compared with integrally formed cutters. These test results indicate that residual stresses can be tailored by thinning the carbide, by varying the content of the substrate and by selecting the method of manufacture of the cutter.

Figure 5:
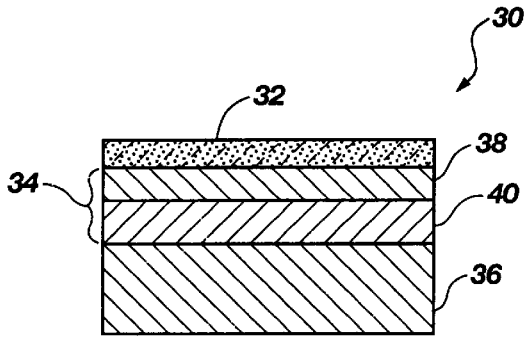
FIG. 5 is a view in cross section of a second embodiment of a PDC cutter of the present invention having a substrate of varying materials content.
Figure 6:
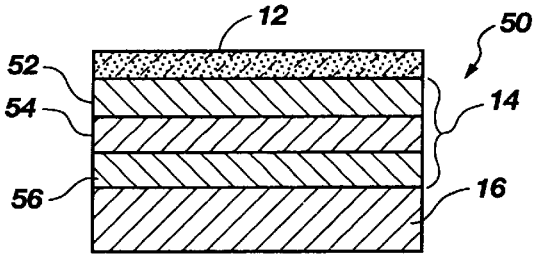
FIG. 6 is a view in cross section of a third embodiment of a PDC cutter of the present invention having a substrate comprised of three layers of disparate materials content.

Notably, Knoop hardness testing conducted on the PDC cutters illustrated in FIGS. 2 and 5 indicated a hardness of 3365 (KHN) in the diamond table of the conventional PDC cutter (13% cobalt content) and a hardness of 3541 (KHN) in the diamond table of the embodiment illustrated in FIG. 5, suggesting that the substrate content and the in-process annealing procedure impart beneficial characteristics of diamond table hardness, as well as modified residual stresses in the diamond table.

A post-process stress thermal treatment cycle is also beneficial in reducing the residual stresses experienced in the diamond table. The post-process stress relief anneal cycle comprises the steps of subjecting a sintered compact (i.e., the diamond table and substrate) to a temperature of between about 650° C. and 700° C. for a period of one hour at less than 200 $\mu$m of vacuum pressure. Notably, the heat up and cool down cycles of the process are controlled over a three hour period to promote even and gradual cooling, thereby reducing the residual stress forces in the cutter.

Comparative Knoop hardness testing performed on a conventional PDC cutter, as described above with a 13% cobalt content in the carbide substrate, and a PDC cutter, as illustrated in FIG. 5, both of which were subjected to a post-process stress relief anneal cycle, demonstrates that both the conventional PDC cutter and the PDC cutter of the present invention experience unexpected increases in hardness levels as compared to a conventional PDC cutter and a PDC cutter of the present invention which are not subjected to a post-process stress relief anneal cycle. The effect of a post-process stress relief anneal cycle on a third kind of PDC cutter having a catalyzed substrate was also observed. These results are illustrated in Table I.

TABLE I

| | Without Post-Process Anneal | With Post-Process Anneal |
|---|---|---|
| Conventional PDC (13% Co Substrate) | 3365 (KHN) | 3760 (KHN) |
| Varied Substrate PDC (13% Co/16% Co) | 3541 (KHN) | 3753 (KHN) |
| Catalyzed Substrate (layer of Co between carbide and diamond) | 3283 (KHN) | 3599 (KHN) |

Figure 12:
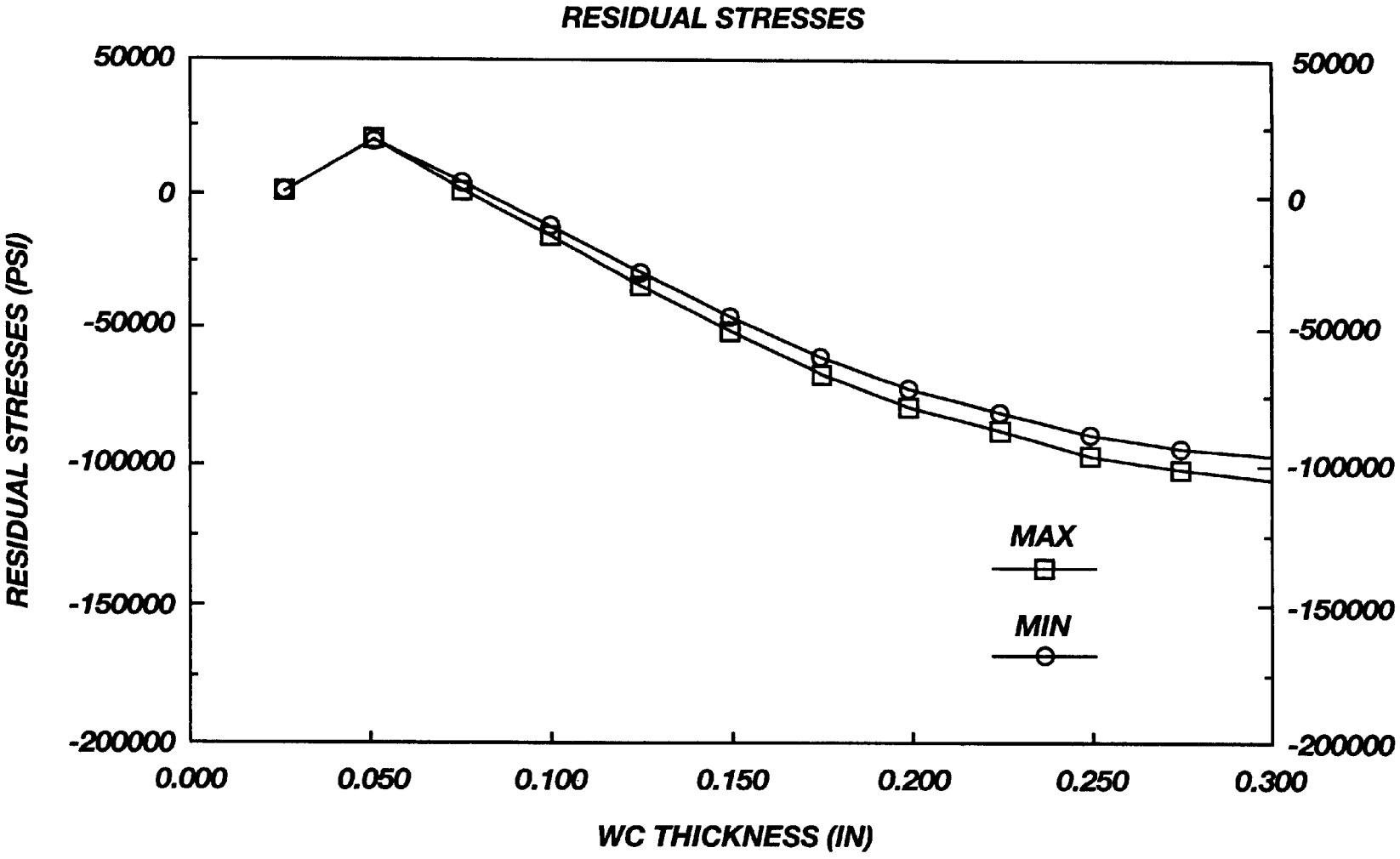
FIG. 12 is a graph illustrating the residual stress analyses of a cutter comprised of a substrate containing 13% cobalt integrally formed to a carbide support which was produced with a post process annealing step.
Figure 13:
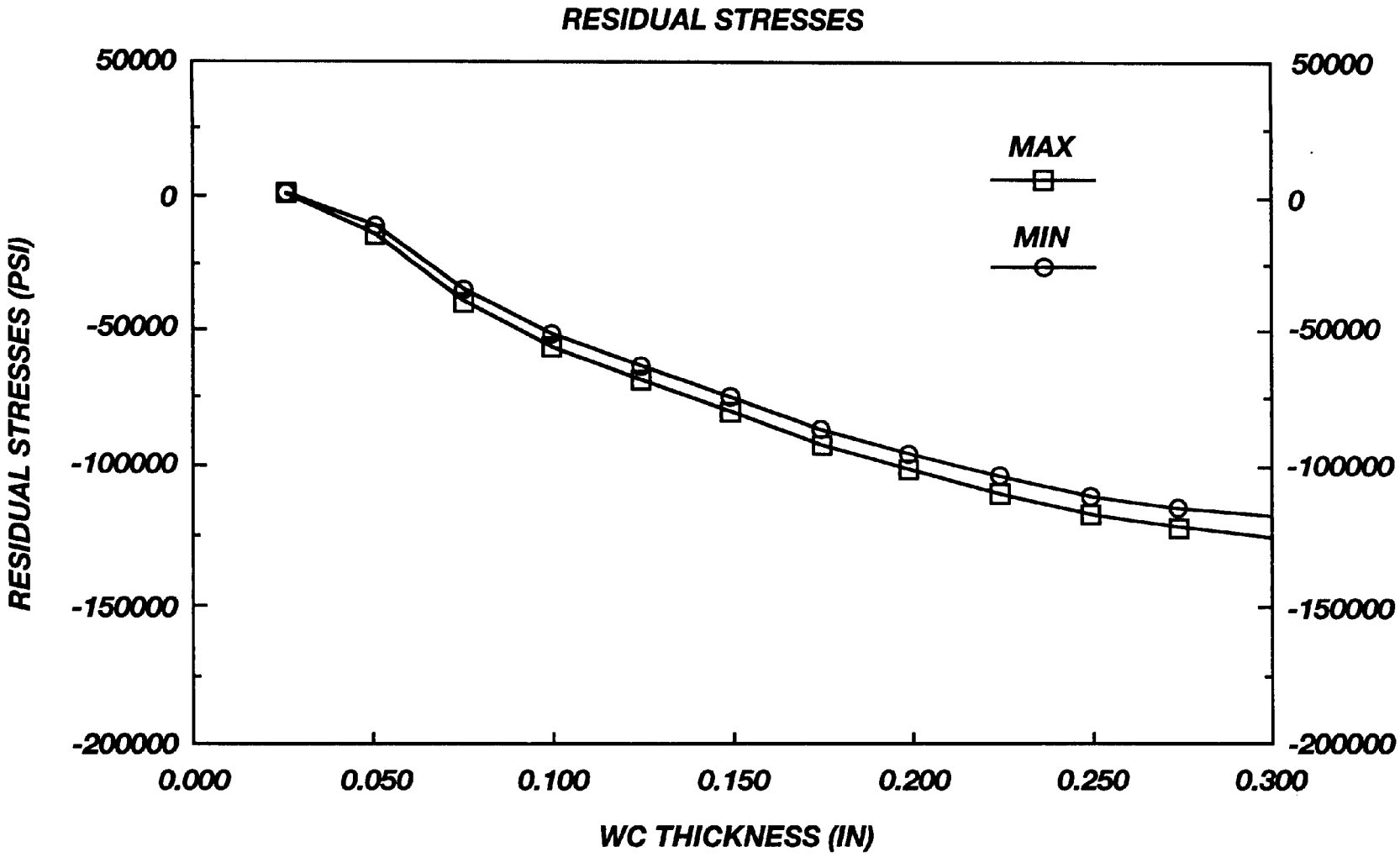
FIG. 13 is a graph illustrating the residual stress analyses of the cutter embodiment shown in FIG. 5 produced with a post process annealing step.

Further evidence of the difference effected on residual stress by use of a post-annealing process can be observed in a comparison of FIG. 7 with FIG. 12. FIG. 7 illustrates residual stress analyses on a cutter having a 13% cobalt-containing substrate which was produced with no post-process annealing, while FIG. 12 illustrates the same embodiment produced with a post-process annealing procedure. The residual compressive stress is a maximum of about 80,000 psi (552 MPa) in the cutter shown in FIG. 3, but is approximately 25% higher, or at about 100,000 psi (about 689 MPa) in the cutter shown in FIG. 12. Additional support can be seen in a comparison of the residual stress analyses shown in FIG. 9 of the cutter embodiment shown in FIG. 5, which was produced without a post-process annealing step and the residual stress analyses shown in FIG. 13 of the cutter embodiment shown in FIG. 5, which was produced with a post-annealing process step. The maximum compressive stress is under about 50,000 psi (about 345 MPa) for the cutter tested in FIG. 9, while the maximum compressive stress is over about 120,000 psi (about 827 MPa) for the annealed counterpart shown in FIG. 13.

The present invention is directed to providing polycrystalline diamond compact cutters having selectively modified residual stress states in the diamond table and substrate or support thereof. Through the means of selective thinning of the substrate and/or support, through the means of selectively modifying the materials content of the substrate, through the means of subjecting the PDC cutter to in-process annealing procedures, and through the means of subjecting a sintered PDC cutter to a post-process stress relief annealing procedure, or combinations of all these means, desired residual stresses and compressive forces in a PDC cutter may be achieved. The concept may be adapted to virtually any type or configuration of PDC cutter and may be adapted for any type of drilling or coring operation. The structure of the PDC cutters of the invention may be modified to meet the demands of the particular application. Hence, reference herein to specific details of the illustrated embodiments is by way of example and not by way of limitation. It will be apparent to those skilled in the art that many additions, deletions and modifications to the illustrated embodiments of the invention may be made without departing from the spirit and scope of the invention as defined by the following claims.

What is claimed is:

1. An improved polycrystalline diamond compact cutter including a carbide substrate secured to a polycrystalline diamond table, the carbide substrate comprised of at least one binder constituent and at least one carbide constituent, the polycrystalline diamond compact cutter comprising a carbide substrate modified to exhibit at least a reduced level of residual tensile stress, as compared to a carbide substrate of a conventional polycrystalline diamond compact cutter in an immediately post-fabricated state, formed by performance with respect thereto of at least one of the acts of: having selectively limited an initial thickness of the carbide substrate of the improved cutter, having selectively reduced an initial thickness of the carbide substrate to a final thickness, having selectively varied at least one of the at least one carbide constituent and the at least one binder constituent of the carbide substrate of the improved cutter, having subjected the polycrystalline diamond compact cutter to an annealing process while securing the polycrystalline diamond table to the carbide substrate, and having subjected the polycrystalline diamond compact cutter to an annealing process after having secured the polycrystalline diamond table to the carbide substrate.

2. The improved polycrystalline diamond compact cutter of claim 1, wherein the final substrate thickness ranges from about 0.025 inches (0.64 mm) to about 0.30 inches (7.62 mm).

3. The improved polycrystalline diamond compact cutter of claim 2, wherein the at least one carbide constituent is selected from the group consisting of tungsten carbide, tantalum carbide, and titanium carbide.

4. The improved polycrystalline diamond compact cutter of claim 3, wherein the at least one binder constituent is selected from the group consisting of cobalt, nickel, iron, and alloys formed from combinations of those metals.

5. The improved polycrystalline diamond compact cutter of claim 2, wherein a thickness of the carbide substrate ranges from about 5 mm (0.20 inches) to about 16 mm (0.63 inches).

6. The improved polycrystalline diamond compact cutter of claim 1, wherein the carbide substrate comprises at least two carbide disks secured together, each having dissimilar materials content from each other.

7. The improved polycrystalline diamond compact cutter of claim 6, wherein the carbide substrate is comprised of two disks secured together, a first disk comprised of approximately thirteen percent (13%) cobalt-containing carbide and a second disk comprised of approximately 16% cobalt-containing carbide.

8. The improved polycrystalline diamond compact cutter of claim 7, wherein the first disk comprised of approximately (13%) cobalt-containing carbide is located adjacent the polycrystalline diamond table.

9. The improved polycrystalline diamond compact cutter of claim 6, wherein the carbide substrate is comprised of three disks formed together, a first disk comprised of approximately thirteen percent (13%) cobalt-containing carbide, a second disk comprised of approximately sixteen percent cobalt-containing carbide, and a third disk comprised of approximately twenty percent cobalt-containing carbide.

10. The improved polycrystalline diamond compact cutter of claim 9 wherein the third disk comprised of approximately twenty percent (20%) cobalt-containing carbide is positioned apart from the polycrystalline diamond table.

11. The improved polycrystalline diamond compact cutter of claim 1, wherein the carbide substrate is formed from an inner, non-planar carbide member positioned within and bonded to an outer carbide member.

12. The improved polycrystalline diamond compact cutter of claim 11, wherein the inner carbide member and the outer carbide member are comprised of dissimilar materials content.

13. The improved polycrystalline diamond compact cutter of claim 11, wherein the inner carbide member is conically shaped and the outer carbide member is sized to receive the inner carbide member therewithin.

14. The improved polycrystalline diamond compact cutter of claim 11, wherein the inner carbide member is cylindrically shaped and the outer carbide member is formed as a sleeve sized to encircle the inner cylindrically shaped carbide member.

15. The improved polycrystalline diamond compact cutter of claim 11, wherein the inner carbide member is hemispherically shaped and the outer carbide member is formed with a depression sized to receive the inner carbide member therewithin.

16. An improved polycrystalline diamond compact cutter including a carbide substrate bonded to a polycrystalline diamond table, the improved polycrystalline diamond compact cutter comprising: at least one constituent added to the carbide substrate inducing a reduction of a state of residual tensile stress in the carbide substrate and inducing an enhancement in a state of residual compressive stress in the polycrystalline diamond table of the improved polycrystalline diamond compact cutter as compared to a state of residual compressive stress in a polycrystalline diamond table and a state of residual stress in a carbide substrate of a post-fabricated, conventional polycrystalline diamond compact cutter.

17. The improved polycrystalline diamond compact cutter of claim 16 wherein the at least one constituent is selected from the group consisting of cobalt, nickel and iron.

18. The improved polycrystalline diamond compact cutter of claim 17 wherein the carbide substrate is formed from at least two carbide discs joined together in a sintering process, the at least two carbide discs containing disparate amounts of the at least one constituent.

19. The improved polycrystalline diamond compact cutter of claim 18 wherein the carbide substrate is formed from a first carbide disc containing thirteen percent cobalt and a second carbide disc containing approximately sixteen percent (16%) cobalt, said first carbide disc being positioned adjacent to said polycrystalline diamond table.

20. The improved polycrystalline diamond compact cutter of claim 19 further comprising a third disc of carbide material containing approximately twenty percent (20%) cobalt.

21. The improved polycrystalline diamond compact cutter of claim 1, further comprising the carbide substrate being attached to a support.

22. The improved polycrystalline diamond compact cutter of claim 21, wherein the support comprises carbide.

23. The improved polycrystalline diamond compact cutter of claim 16, further comprising the carbide substrate being attached to a support.

24. The improved polycrystalline diamond compact cutter of claim 23, wherein the support comprises carbide.

25. The improved polycrystalline diamond compact cutter of claim 16, wherein the constituent includes a quality that has been manipulated to effect the constituent's ability to induce a reduction of the state of residual tensile stress in the carbide substrate of the improved polycrystalline diamond compact cutter.

26. The improved polycrystalline diamond compact cutter of claim 16, wherein the at least one constituent includes a quality that has been manipulated to effect the at least one constituent's ability to induce an increase of the state of residual compressive stress in the polycrystalline diamond table.

* * * * *